United States Patent [19]

Rice

[11] 4,108,797

[45] Aug. 22, 1978

[54] CATALYST FOR SELF IGNITION OF FUELS

[75] Inventor: Richard E. Rice, Arlington, Mass.

[73] Assignee: Comstook & Wescott, Inc., Cambridge, Mass.

[21] Appl. No.: 838,318

[22] Filed: Sep. 30, 1977

Related U.S. Application Data

[63] Continuation-in-part of Ser. No. 561,591, Mar. 24, 1975, abandoned, and a continuation-in-part of Ser. No. 601,228, Aug. 1, 1975, Pat. No. 4,047,876.

[51] Int. Cl.[2] ..... B01J 21/04; B01J 23/40

[52] U.S. Cl. ..... 252/466 PT

[58] Field of Search ..... 252/466 PT, 477 R; 431/2, 4, 7

[56] References Cited

U.S. PATENT DOCUMENTS

| | | | |
|---|---|---|---|
| 3,191,659 | 6/1965 | Weiss | 431/328 X |
| 3,198,240 | 8/1965 | Keith et al. | 252/466 PT |
| 3,669,904 | 6/1972 | Cornelius et al. | 252/466 PT |

*Primary Examiner*—W. J. Shine

[57] ABSTRACT

A catalyst for self ignition and combustion of a fuel such as the lower alcohols namely methanol, ethanol and isopropanol and comprises a small pellet body, preferably of gamma alumina which is integrated with a metal of the platinum family. The metal is present in amounts from 16% to 60% of the weight of the body. With such concentration, the pellet is effective to self-ignite the alcohol above and below normal ambient temperatures and humidity.

5 Claims, 4 Drawing Figures

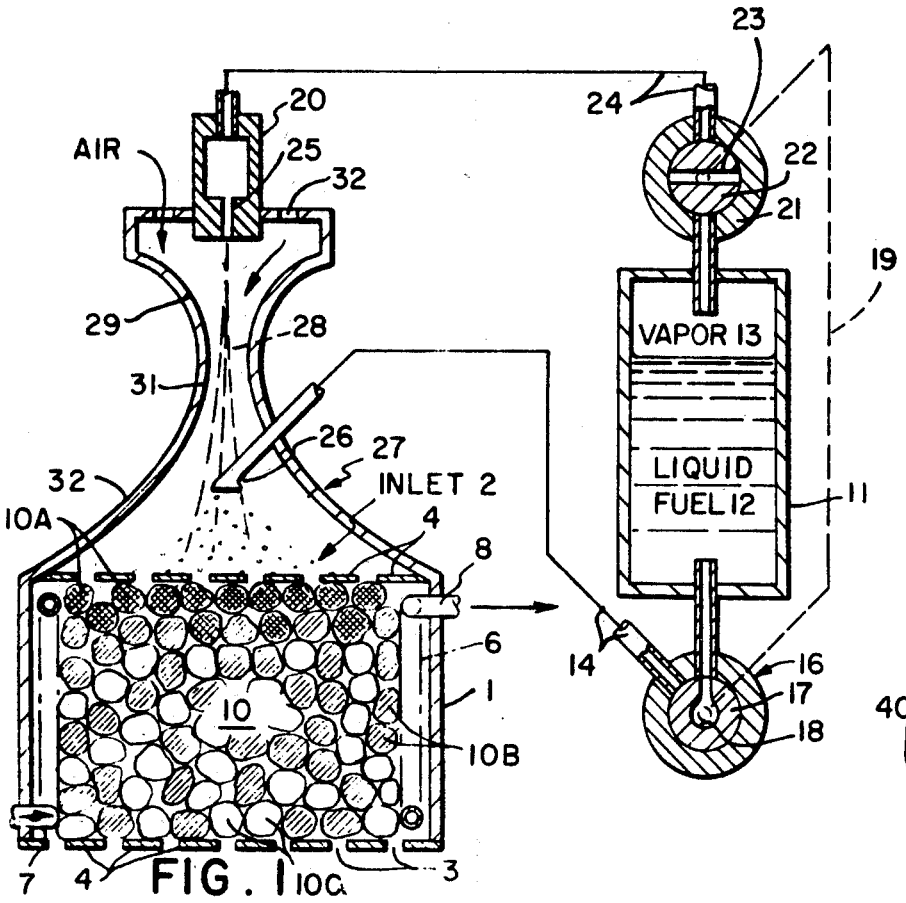
FIG. 1
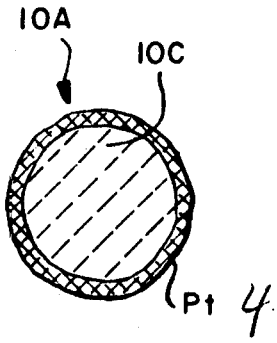
FIG. 3
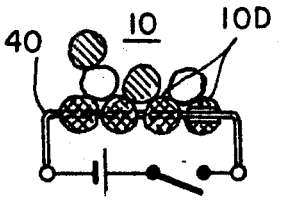
FIG. 4
| CATALYST PELLET SYMBOLS | |
|---|---|
| 10A HIGH PLATINUM FAMILY CONCENTRATION | |
| 10B LOW PLATINUM FAMILY CONCENTRATION | |
| 10C POROUS BODY | |
FIG. 2

CATALYST FOR SELF IGNITION OF FUELS

RELATED APPLICATIONS

This is a continuation-in-part of my pending U.S. applications Ser. No. 561,591, filed Mar. 24, 1975, now abandoned and Ser. No. 601,228, filed Aug. 1, 1975, now U.S. Pat. No. 4,047,876 both entitled Catalytic Fuel Combustion Apparatus and Method, which are incorporated herein by reference and Ser. No. 638,887 filed Dec. 8, 1975, now abandoned, and Ser. No. 800,421 filed May 25, 1977, now abandoned entitled Catalyst for Self Ignition of Hydrogenous Fuels.

BACKGROUND OF THE INVENTION

The present invention relates to heating systems in which a mixture of a fuel vapor and air are burned flamelessly on the surface of a catalyst. The invention relates particularly to the rapid and efficient starting of the combustion of the fuel when both the fuel and the catalyst are initially cold; i.e., at a temperature near room temperature or lower.

The catalytic oxidation of hydrocarbons, alcohols, and other chemicals at elevated temperatures has been practiced efficiently for many years in industrial processes, and more recently in such applications as small space heaters fueled by propane. A characteristic of such applications is that they operate steadily for relatively long periods, and are started from an initially cold state only infrequently. Thus, the catalytic space heater can be ignited with matches, and large industrial catalytic systems can be brought slowly up to operating temperature by auxiliary heaters. Such systems would be more conveniently started by a self igniting catalyst.

For certain applications which might be most advantageously served by catalytic heaters, however, the heating periods are very short and the system must be heated frequently from a cold start; hence very rapid and efficient initiation of combustion is mandatory, and an auxiliary heating system for starting combustion is unacceptable. One such application is the heating of shave foam or cosmetics dispensed from an aerosol can, where a few grams of material must be heated about 50° to 80° F in a period of 10 to 20 seconds, or less. In this case the heating system must be small and inexpensive, but capable of developing high heating intensities very quickly, and also capable of completely burning the fuel without production of noxious combustion products. It is also imperative that the system be highly efficient in converting and transferring the heating value of the fuel into the fluid which is to be heated.

Experience has shown, however, that suitable fuels, such as hydrocarbons and alcohols, when vaporized and mixed with air, will not start to burn spontaneously when brought into contact with catalysts of the types commonly used, unless the catalyst or the fuel, or both are preheated.

A further difficulty encountered in the use of conventional catalyst results from the fact that the catalytically active metal, for example platinum black, is most effective when supported upon highly porous base materials such as gamma alumina or silica gel, which are highly hydroscopic. Of the known catlyst compositions a mulled mixture of platinum and silica found in a small pellet may exhibit self ignition of methanol, but the reliability of such a pellet after exposure to high humidity is questionable. Commercially available pellets of alumina impregnated with small amounts, that is, less than 1%, of platinum family metal will not self ignite lower alcohols except at temperatures well above even high ambient temperatures. Thus, between heating periods when the system is cool, the catalyst support material absorbs moisture from the ambient air which greatly reduces the activity of the catalyst. This will completely block the spontaneous oxidation of preferred fuels such as methanol on the surface of the catalyst when both catalyst and fuel are initially cold. U.S. Pat. No. 3,191,659 to G. Weiss describes 30 mesh grains of alumina impregnated with ½ to 10% platinum by weight. The platinum concentration is then diminished by deposition on a fibrous sheet, but in any case my experience has shown that even a 10% concentration of platinum on alumina is ineffective to self ignite the lower alcohols at ambient temperatures after several days of exposure to an expectable range of natural humidity.

Accordingly it is the object of the present invention to provide a catalyst which will rapidly and reliably cause spontaneous ignition of lower alcohol fuels at hyper- and sub-normal temperature and humidity.

STATEMENT OF THE INVENTION

According to the invention a catalyst for combustion of a hydrogenous fuel, such as a lower alcohol comprises a body of porous, fuel absorbent alumina integrated with one or more metals of the platinum family in an amount effective to self ignite the fuel in less than 8 seconds after the catalyst has been exposed to hyper normal humidity. Preferably the porous body is gamma alumina. The amount of the metal should be sufficient to provide a ratio of about 16 and 60% by weight of the integrated portion of the porous body.

DRAWINGS

FIG. 1 is a schematic view showing a fluid heating apparatus with catalyst pellets according to the invention;

FIG. 2 is a table of catalyst pellet symbols as used in the figures;

FIG. 3 is a cross-section of a highly concentrated catalyst pellet; and

FIG. 4 is an elevation view showing catalyst pellets strung on a wire.

DESCRIPTION

Two-Phase Fuel Combustion — FIG. 1
Fuels
Catalysts — FIGS. 2 and 3

Two-Phase Fuel Combustion — FIG. 1

The catalytic combustion apparatus of FIG. 1 comprises a tubular metal casing 1 having an upper fuel inlet 2 and a lower combustion product outlet 3 covered by screens 4. Surrounding the combustion chamber within the casing 1 is a coil of metal tube 6 with an entrance 7 and exit 8 for a fluid to be heated. The remaining volume within the chamber is filled with a bed of catalyst pellets 10 of three types 10A, 10B, 10C as shown in FIGS. 2 and 3.

Fuel is supplied to the combustion chamber 1 from a pressurized container 11 holding a hydrogenous fuel in liquid phase volume 12 and vapor phase volume 13. Fuel from the liquid volume is fed to a conduit 14 through a metering valve 16 whose rotating plug 17 has a space 18 for holding a predetermined amount of fuel which is released into the conduit upon 45 counter clockwise rotation of the plug from the position shown in FIG. 1. The metering valve plug 17 is coordinated with the plug 22 of a vapor valve 21 by a mechanical coupling 19. The vapor valve plug 22, upon 90° rotation from the position shown, connects the vapor volume 13 with a vapor conduit 24.

The liquid fuel conduit 14 leads to an atomizing nozzle 26 within an air aspirator 27, the nozzle spraying the metered amount of liquid fuel in fine droplets toward the fuel inlet 2 to the combustion chamber 1. Immediately inside the inlet is a mass of catalyst pellets 10A with a high concentration of catalyst in the platinum family described more fully hereinafter. A hydrogenous fuel such as methanol will spontaneously ignite in flameless combustion on contact with a high platinum family concentration. Simultaneously with, or shortly after ignition fuel in vapor phase is supplied through conduit 24 to a nozzle 20 with an orifice 25 which meters the continuous flow of vapor and directs it in a jet 28 through the convergence 29, throat 31 and divergence 32 of the aspirator toward the fuel inlet 2 to the combustion chamber. The vapor jet entrains air and draws it through openings 32 adjacent the metering nozzle 20, mixing the fuel and air as they approach the combustion chamber so that flameless catalytic combustion is sustained by continued flow of the fuel in its vapor phase.

Heat from the combustion is exchanged with fluid flowing through the coil 6, which fluid may be a gas such as air or a liquid such as water, either of which can be circulated through radiators or other apparatus.

A catalytic heater of the type described above and having a double helical coil as shown in FIG. 4 was tested to determine its characteristics as a water heater. For this purpose, the inlet was connected to a water source which provided a constant water flow rate of 1.38 grams per second. The measured temperature rise of the water was 12.8° C. The total volume of the catalytic heater, i.e. the catalyst bed, was 8.05 cubic centimeters. The heating intensity of this system was thus 2.2 calories per second per cubic centimeter or in other units 890,000 BTU per hour, per cubic foot. The importance of this high heating intensity can be visualized in terms of a familiar application such as a house heater which might typically have a capacity of 150,000 BTU per hour. The catalytic heater described above scaled to a capacity of 150,000 BTU per hour would occupy a volume of only 0.169 cubic foot. Along with this remarkable heat intensity the heater operates with high efficiency and fuel economy, and low pollution in its combustion products.

Fuels

Of the many available fuels only four are known to ignite spontaneously and safely in the presence of a suitable catalyst at normal ambient temperature, that is 40° to 100° F. Other fuels such as formaldehyde, formic acid and hydrazine hydrates will oxidize spontaneously but are toxic, inconvenient and dangerous to handle. Thus, safe spontaneously igniting fuels are hydrogen and the three lower alcohols, methanol, ethanol and isopropanol; methanol being preferred. While other hydrocarbons such as natural gas or the lower alkanes may be used as a primary fuel after ignition they will not start catalytic combustion spontaneously. Thus either in industrial processes using primary fuels after ignition or in intermittently started catalytic combustion apparatus using the starting fuel as an operating fuel also the lower alcohols are useful.

Whereas primary fuels are delivered from a pressurized system, smaller apparatus run on the starting fuel requires fuel pressurization by air or a self pressurizing fuel. For catalytic combustion the lower ethers, dimethyl and methyl ethyl ether, and lower alkanes and alkenes have been found to be most suitable as a pressurizer when mixed with the lower alcohols. The mixture of methanol and dimethyl ether as a catalytic fuel is mentioned generally in U.S. Pat. No. 2,764,969 to Weiss. Such a fuel mixture has, however, been found to have a rather critical range of alcohol ether proportion, particularly in small fuel containers used in portable or compact selfigniting combustion units such as are described herein. While the ether is a fuel, the alcohol which is essential to start combustion has a substantially lower vapor pressure, so that as fuel is withdrawn from the vapor space of a fuel container the concentration of ether in the liquid phase drops resulting in a drop of vapor pressure. When the pressure is reduced to the point that the heating rate is below the useful limit a residue of unusable fuel remains in the container. When the pressure drops to atmospheric the liquid residue is substantially all alcohol. I have found that if the alcohol is is excess of 25% by volume of the initial alcohol-ether mixture an unusable residue of fuel in excess of 35% of the original fuel volume will result in substantial economic waste. On the other hand a proportion of approximately 5% alcohol by volume is required to insure spontaneous ignition. Within the range of 5 to 25% alcohol (e.g. methanol) to 95 to 75% ether (e.g. dimethyl ether) 10% alcohol and 90% ether is preferred.

Although the loss of pressure and waste of alcohol could be avoided by withdrawing fuel from the liquid volume 12 of the container 11, the liquid fuel would be evaporated in the aspirator 27 or in the mass 10 of catalyst pellets. Such fuel evaporation produces a refrigeration effect which will reduce or inhibit ignition or continue combustion. However, according to one aspect of the invention, metering only a small amount of alcohol-rich liquid fuel does not inhibit spontaneous ignition, and subsequently supplying fuel preevaporated in the fuel container 11 isolates the combustion chamber 27 from the refrigeration effect. The fuel container can absorb and dissipate the refrigeration remotely from the combustion chamber. Further the fuel container has sufficient mass and external heat transfer surface to prevent excessive chilling of the fuel therein.

While the alcohol-ether pressurizer mixture described above has been found to be a reliable starting and running fuel, particularly in a single fuel container delivering the fuel in liquid and vapor phase, several advantages have been found in the use of lower alkane, alkene and cyclo hydrocarbons with less than five carbon atoms as a pressurizer for the alcohols and as a primary, separately supplied fuel for continued catalytic combustion after spontaneous ignition with a lower alcohol-fuel mixture. Thus the preferred fuels for use in the present apparatus and method comprise not only ethers with less than four carbon atoms including dimethyl and methyl ethyl ether, but also the lower alkane and alkene hydrocarbons with a boiling point below nominal room temperature including methane, ethane, propane including cyclo propane, butane including n-butane and isobutane, ethylene, propylene, butene-1 and -2, butadiene and butylene including isobutylene.

As a pressurizing constituent of the lower alcohol starting mixture the lower hydrocarbons mentioned may comprise as little as 5% of the fuel mixture with 95% of the mixture rich in alcohol. As previously noted the alcohol may be as low as 5% by volume, but higher concentrations approaching 95% by volume are preferred because catalytic combustion will start spontaneously more rapidly and reliably, particularly in humid weather, if the starting fuel is rich in alcohol. A mixture of 60% methanol and 40% isobutane, for example, affords reliable starting in ambients of 90% relative humidity, and at temperatures below 40° F.

Catalysts — FIGS. 2 and 3

A platinum family catalyst is necessary for spontaneous ignition of the previously mentioned hydrogenous fuels. The platinum family includes the platinum group of metals platinum, iridium and osmium, and the palladium group of palladium, ruthenium and rhodium. Preferably the platinum family catalyst is supported on a catalytically active porous body composed of one or more of the porous forms of alumina. The porous catalytic supports are relatively inexpensive whereas platinum family metals are very expensive. Therefore, prior catalytic bodies have very little platinum family metal. Porous catalytic pellets with a platinum content of approximately 0.05 to 0.2% by volume are used in industrial processes which are brought to combustion temperature but which cannot initiate spontaneous ignition. Similarly the above named porous bodies cannot alone initiate spontaneous combustion, and are, moreover, powerful adsorbers of atmospheric moisture and fuel at ordinary temperatures. For example, a bed of 0.1% platinum black supported on the surface of small ($\frac{1}{8}$ inch) spherical pellets of highly porous gamma alumina, after several hours of exposure in a combustion chamber to air of normal humidity, will not catalyse the oxidization of an air-methanol fuel at room temperature. Nor will such a catalytic body initiate spontaneous combustion of liquid or vapor phase fuel mixture of 5 to 25% methanol in dimethyl ether.

I have found that the ignition inhibiting effect of adsorbed moisture is overcome by substantially increasing the platinum family content of the porous catalytic body to at least about 16% and in a range up to 60% of the initial weight of the porous body.

Below approximately 16% spontaneous ignition does not occur and an undesirably high amount of formaldehyde is produced and above 60% the time for combustion to start begins to increase. Within the range of 16 to 60% platinum, the fastest starting of spontaneous ignition is assured even after the catalyst has been exposed to extreme, naturally expectable humidity.

Catalytic bodies with such a high platinum family content are, of course, relatively costly but I have further found that only a small proportion of the catalyst bed 10 within the combustion chanber 27 need consist of the enriched or highly concentrated 16 to 60% platinum family bodies 10A, symbolized by cross hatched areas in FIG. 2, and that less costly platinized porous bodies 10B with under 16% platinum family concentration (preferably under 2% platinum) symbolized by unshaded areas in FIG. 2, may be used as the major portion of the catalytic mass 10.

The preferred form of enriched catalytic pellet is a porous support of gamma alumina with over 16 to 60% platinum black or palladium integrated with the alumina as shown in FIG. 3. Alumina and silica with less than 16% platinum is not reliable for starting under unfavorably high humidity which will normally occur under natural conditions. Gamma alumina integrated with between about 16% and 60% by weight of platinum family metal will reliably start spontaneous ignition within 1 to 8 seconds under natural hyper humidity and even extreme artificial hyper humidity.

In special applications where starting is desired in all cases in 1 or 2 seconds, it may be preferable to use the enriched pellets strung as beads 10D, as in FIG. 4, or otherwise supported integrally with a resistively heated wire 40 of nichrome stainless steel or the like.

The lower (under 2%) platinum family concentration bodies 10B may consist of platinum applied to the surface of gamma alumina pellets. Herewith the catalytic activity of the metal is augmented by the catalytic activity of the gamma alumina, which together cause complete oxidization of methanol with little or no formaldehyde production.

The unplatinized catalytic pellets 10C are also preferably porous gamma alumina.

The bodies 10A of high catalytic concentration are disposed at the fuel inlet 22 to the combustion chamber 1 where they will initiate spontaneous combustion dispite the fuel refrigeration effect and the presence of adsorbed moisture.

Starter pellets 10A, although exposed to humid air for days will ignite catelytic combustion within a few seconds when exposed to methanol. Combustion will then dry the less enriched pellets and spread through the bed.

EXAMPLE

Slightly more than 125 grams of gamma alumina pellets were baked at 125° C. for about 3 hours to remove water. Exactly 125 grams were measured and immersed in a 10% by weight solution of chloroplatinic acid. The pellets were then heated in a pyrex dish overnight at 125° C. followed by a reduction in a flowing stream of hydrogen for 1 hour at 125° C. The dried and reduced pellets weighed 144.5 gm. (15.6% by weight Pt.).

The pellets were then treated for a second and a third time in the same manner as above and weighed. They weighed 182 gm. (45.6% by weight Pt.) following the third treatment.

To test the pellets for catalytic activity, theywere disposed in a stream of isopropane at which point they began to glow bright red, and heat was produced.

It should be understood that the present disclosure is for the purpose of illustration only and that this invention includes all modifications and equivalents which fall within the scope of the appended claims.

I claim:

1. A catalyst for the combustion of a methanol fuel comprising:

a body of porous, fuel absorbent alumina, and an amount of one or more metals of the platinum family integrated with a major portion of the surface of said alumina, the amount of said metals integrated with said alumina being sufficient to provide a ratio of about 16 to 60% by weight of the integrated portion so that a catalyst body which has been exposed to hypernormal humidity can self-ignite said fuel.

2. The catalyst according to claim 1 wherein the body is gamma alumina.

3. The catalyst according to claim 1 in integral combination with a resistance heating conduit supporting the catalyst.

4. The catalyst according to claim 3 wherein the catalyst is in the form of a bead strung on the conductor.

5. The catalyst according to claim 1 wherein the body of alumina is a porous pellet.

* * * * *